United States Patent [19]

Ribas

[11] 4,235,562

[45] Nov. 25, 1980

[54] LAND RECLAMATION SYSTEM

[76] Inventor: Alberto L. Ribas, 9115 SW. 25th St., Miami, Fla. 33165

[21] Appl. No.: 967,784

[22] Filed: Dec. 8, 1978

[51] Int. Cl.[2] ..... E02D 3/00

[52] U.S. Cl. ..... 405/128; 210/806; 299/19

[58] Field of Search ..... 405/128, 129, 258; 210/65, 83, 170; 299/10, 19

[56] References Cited

U.S. PATENT DOCUMENTS

| | | | |
|---|---|---|---|
| 3,718,003 | 2/1973 | Cook et al. | 405/129 |
| 3,775,984 | 12/1973 | Livingston | 405/128 |
| 3,978,673 | 9/1976 | Schleede | 405/128 |

*Primary Examiner*—David H. Corbin

*Attorney, Agent, or Firm*—Clarence A. O'Brien; Harvey B. Jacobson

[57] ABSTRACT

An improved procedure is disclosed for reclaiming land as it is surface mined; more particularly, reclamation of mined-out phosphate-containing land is disclosed where strata comprising a sandy component, a phosphate pebble component and a slime component are excavated, and the sandy component and the slime component are returned after extraction of the phosphate pebble component and dewatering by the dewatering system of the present invention. The volume of returned material is equal to or less than the volume of mined material, and the returned material forms a stable and agronomically sound soil. This result is obtained by accelerating dewatering of the slimes component of a specially treated backfill prior to and after deposition in the mined-out pit.

20 Claims, 8 Drawing Figures

GYPSUM

LAND RECLAMATION SYSTEM

BACKGROUND OF THE INVENTION

1. Field of the Invention

The invention relates to a system for reclaiming mined land, particularly land surface mined for extraction of phosphate values. The land surface to be mined is divided into contiguous parallel rows, and alternate rows are mined sequentially. Specially treated backfill is generated in the present invention to fill the row previously mined. The treatment process uses a thickener device which treats the sandy component and the slime component remaining in a large excess of water after extraction by water of the phosphate component. The thickener extracts water from the output of slime component for reuse or conservation, and additionally fills voids within the sandy component with the slime component to further reduce the volume of output.

2. Description of the Prior Art

Separation of solids and liquids by flocculation, filtration, settling, sedimentation, and decantation is known in the prior art. For example, Robinson in U.S. Pat. No. 1,855,610 shows a honeycomb arrangement for purifying a liquid with a suspended clay, where an upper overflow free of clay is removed from a filtering cylinder. Solid-liquid separation is also shown by Rice et al in U.S. Pat. No. 3,615,025 by use of a tube bank. Bounin in U.S. Pat. No. 2,816,660 discloses passing a grid or screen at very low speed through a flocculated mass for decanting liquid suspensions. Radial feed pipe lines for a thickener tank having a rotating rake are shown by Adams in U.S. Pat. No. 2,069,989.

Other patents showing aspects of prior art arrangements for separating suspended solids from liquids are the following:

U.S. Pat. No. 1,983,894—Dec. 12, 1933
U.S. Pat. No. 2,009,559—July 30, 1935
U.S. Pat. No. 2,047,798—July 14, 1936
U.S. Pat. No. 2,274,361—Feb. 24, 1942
U.S. Pat. No. 2,763,371—Sep. 18, 1956
U.S. Pat. No. 2,861,692—Nov. 25, 1958
U.S. Pat. No. 2,878,935—Mar. 24, 1959
U.S. Pat. No. 2,963,157—Dec. 6, 1960
U.S. Pat. No. 3,067,878—Dec. 11, 1962
U.S. Pat. No. 3,292,788—Dec. 26, 1968
U.S. Pat. No. 3,374,885—Mar. 26, 1968
U.S. Pat. No. 3,412,863—Nov. 26, 1968
U.S. Pat. No. 3,578,586—May 11, 1971.

Prior systems for separating liquids from suspended solids have failed to provide a means for simultaneously accomplishing dewatering of a suspension and filling of voids in a filtering material. Only by accomplishing both functions can a backfill material be generated which fills mined areas with a stable and agronomically sound soil. Furthermore, none of the patents shows a method of dividing a mined area into rows, followed by mining alternate rows and depositing the treated back fill in the previously mined row. Consequently, prior art treatments of the products of phosphate separation have yielded a product with substantially greater volume than the extracted material, necessitating dams or other impounding techniques for storing such materials, with consequent hazards of dam failure and a high rate of water consumption.

SUMMARY OF THE INVENTION

The present invention overcomes these and other difficulties by providing in combination an alternate row mining technique with an ore processing system permitting redeposit of treated ore wastes.

If an area to be mined is regarded as approximately in the shape of and divided into a checkerboard having rows, the method of the present invention provides for excavating with a dragline ore containing material in a single row, processing and treating the excavated material, skipping over the adjacent row to the third row of the checkerboard, excavating and processing the material of the third row, then discharging the treated waste material from the third row into the void volume of the first row. Resembling the movement of a chess knight in the game of chess, this sequential movement of the dragline from row to alternate row allows compaction of the treated backfill material deposited in excavated rows. When alternate rows covering the entire checkerboard-shaped land area have been excavated and backfilled with treated material, the first row has compacted sufficiently to support the weight of the excavating equipment used to excavate the second row, and then the fourth row and other remaining rows alternately can be excavated, treated, and backfilled in the same chess knight movement pattern.

In order for the chess knight pattern of mining to properly proceed, it is necessary that the volume of treated material used as backfill have a volume no greater than the volume of material excavated initially. Since the ore beneficiation process of separation of phosphate-containing pebbles from a clay component and a sandy component is conventionally accomplished by addition of water, the clay component leaves the beneficiation apparatus in the form of a highly dispersed suspension in water, and the beneficiation apparatus output has several times the volume, even after removal of phosphate pebbles, than the material originally mined. Special treatment methods are used in the present invention to efficiently dewater the beneficiation apparatus output, while simultaneously compacting the clay component and sandy component by filling the voids between sand particles with finely divided clay particles.

The present invention provides a dewatering system comprising a sand filtration system for treating a water suspension of clay, referred to herein as a slime or as clay slimes, by a combination of filtration through a sandy material, sedimentation on the surface of a sandy layer, and clarifying of the clay suspension with use of a honeycomb structure in the same equipment.

The invention is particularly suited for use with phosphate mining, or with any mining operations where on-site water treatment of an ore containing a slime-forming component is involved.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 2:
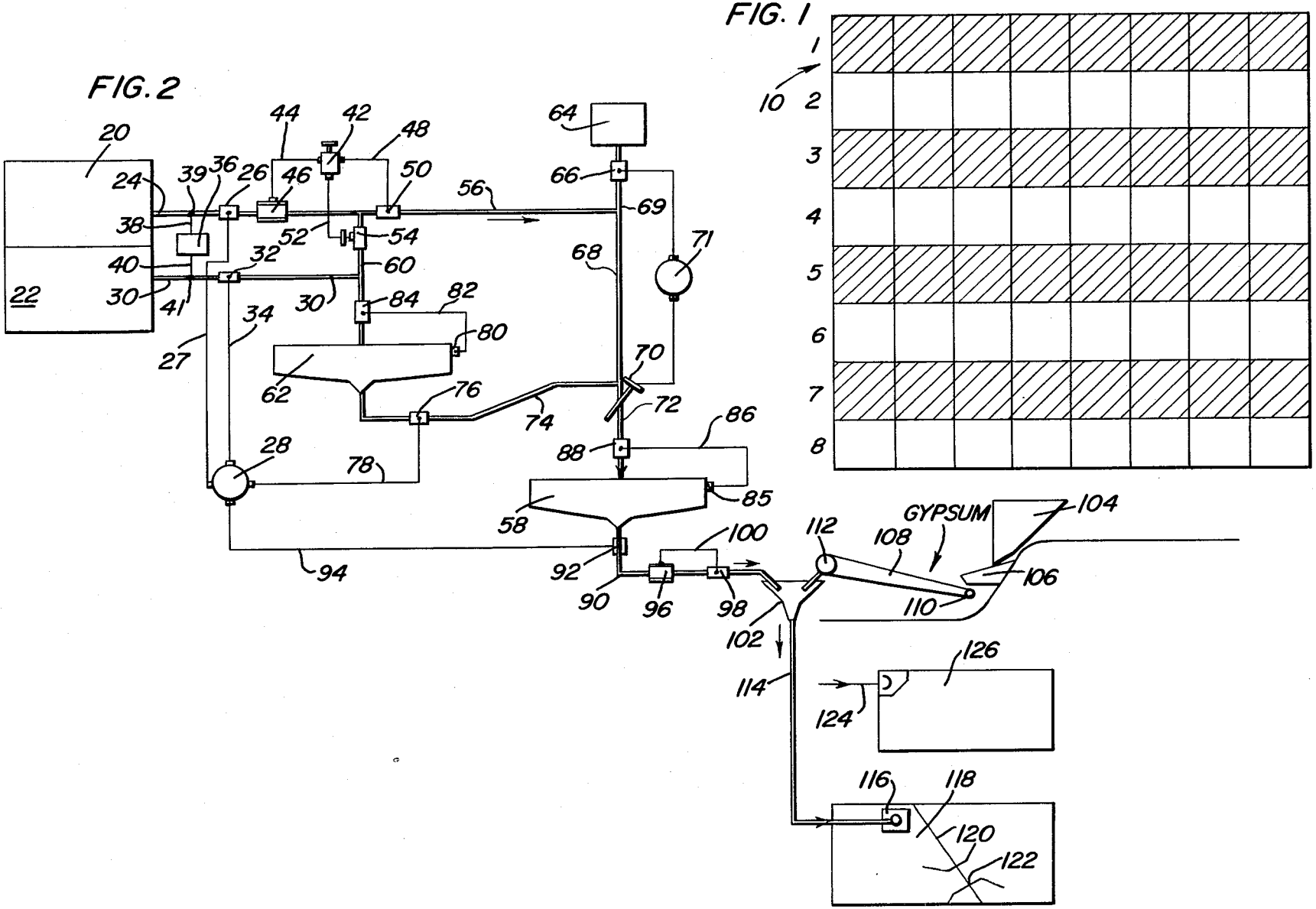
FIG. 1 is an aerial view of a field or area of land in the shape of a square, as divided into rows numbered from 1 to 8, illustrating mining of alternate rows in the fashion of a chess knight movement pattern.
FIG. 2 is a schematic view showing the sand filtration system of the present invention.

The invention will be described with reference to specific conditions encountered in phosphate strip mining in certain areas of the southeastern States of the United States, but it is to be understood that the invention is applicable to many mining situations with different ores than phosphates, different ratios of components, and other components than sandy component, ore pebbles, and slime. However, the invention is limited in applicability to mining situations where an overburden stratum overlies an ore-bearing stratum, the ore-bearing stratum contains a substantial proportion of clay or other slime-forming component, either the overburden stratum or ore-bearing stratum contains a substantial proportion of sandy component, and processing or beneficiation of the ore-bearing stratum can be carried out by addition of water to form a slime waste product. The present invention provides a means for reclaiming the land so mined by replacing the overburden and ore-bearing strata with material forming a stable, agronomically sound soil.

Specifically, with respect to phosphate strip mining, overburden sand, primarily quartz sand, is presently removed from a large ore pit and used to fill an adjacent pit. Phosphate pebbles and associated clay particles are mined from the ore-bearing stratum, mixed with water near the mining site to separate the phosphate pebbles, and the slimes and water are impounded in settling ponds for dewatering by settling out of suspended clay solids. Due to the colloidal nature of the clay slimes, which leave the ore treatment waste dispersed in about 20 to 50 times their weight of water, impounded clay slimes are kept in suspension for a protracted period. The clay slimes are made up of particles largely under five microns in size, and a large proportion of the slime comprises submicron size minerals, primarily clays of the montmorillonite family, having the inherent characteristic of retaining water indefinitely. Consequently, settling of the slime in the settling ponds is prevented from proceeding beyond about 12 to 15% solids after a period of one year, and a maximum of about 25% solids can be achieved after several years of settling in such ponds. Because slimes having 10% solids occupy about 100% more volume than the original ore-bearing stratum, settling ponds required for the clay slime output of ore treatment apparatus requires additional land for its impoundment. In addition to the cost of settling pond land, having potential value for farming, residential and industrial use, costly maintenance of the slime pond dams or dikes is required to prevent stream pollution or inundation of surrounding areas by the fluid slime. A further potential hazard to life and property exists from the fluid slime in the event that the dams or dikes wash out under heavy rains, hurricanes, or otherwise. Furthermore, recovery or reuse of water from the slime is a problem of importance due to a falling water table in some mining areas and to increased demand for water for municipal, domestic and irrigation uses.

Four obstacles stand in the way of utilization of these clay slimes formed in the present process of washing, screening and flotation of phosphate ore, as outlined above. First, the low percentage of solids, ranging from about 2 to 5%, in these slimes generates the need for settling ponds; second, long periods of time are required for settling of the solid material; third, even after settling, the settled slimes have a remaining high water content; and fourth, the various mineral constituents have extreme fineness or a colloidal nature. The practical consequence of these obstacles or properties is that slimes containing as low as 20% solids display an almost jelly-like consistency, with handling problems similar to those of clay slurries, where materials containing less than about 30 to 40% solids will slump and flow under pressure, rendering storage in open piles quite impractical. Since approximately one-third of the mined ore-bearing stratum is quartz sand, and a major proportion of the overburden is sandy, containing small portions of clays and in certain areas, leached zone minerals, the use of sandy materials from both the overburden stratum and ore-bearing stratum as a filter medium, where the voids within the sand particles are filled with filtered clay particles, coupled with dewatering of the clay-containing slimes during the filtration process, it has been found that the present invention permits redeposition of sandy materials where voids between sand particles are eliminated. All waste products can then be redeposited in the mined-out pits to eliminate the necessity of constructing and maintaining dams for settling ponds. Calculations show that where voids in the sandy overburden are eliminated, slimes need only be dewatered to the level of 24% solids, instead of the 40% solids level required if overburden voids are not filled with clay particles.

Furthermore, the present invention provides means for discharging the waste products which prevents separation of sand from slimes, thereby assuring that sandy voids will remain filled and allowing 100% land reclamation in all mined out pits within one year. While overburden contains a small amount of clay which will hydrate slightly, the moisture will be taken from thickened slimes, thereby speeding up the consolidation of the waste material. The final waste product recast in mined-out pits contains a mixture of sand and slime in a ratio of about three to one. When this ratio is approached or exceeded, separation of sand solids from mixes can be avoided, consolidation within a reasonable time is possible, and complete land reclamation is possible. The higher proportion of dry basis sand to slime solids is required to enhance the dewatering effect on the slimes, and to improve the load bearing capacity of the resulting soil to a safe value.

When the chess knight movement pattern of excavating alternate rows is employed, such as by mining row 1 in FIG. 1, followed by mining row 3 and discharging wastes comprising sand particles with voids filled by clay particles into row 1, followed by mining of row 5 and discharging wastes into row 3 and continuing in this manner, it is possible to complete the mining and processing of materials from odd-numbered rows, and then to repeat the process with row 2, 4, and alternate rows not earlier mined, since the reclaimed rows 1 and 3 now have consolidated to permit support of dragline mining equipment for mining row 2. After mining of row 2, row 4 can be mined, since at that time, backfill in rows 3 and 5 will have consolidated to support the mining equipment, and the waste produced in processing of ore removed from the ore-bearing stratum of row 4, together with admixed overburden is deposited in row 2. When row 8 of FIG. 1 has been mined, it in turn can be filled with waste generated from an adjacent tract or with overburden saved from row 1. In FIG. 1 a square tract of land 10 is illustrated divided into sixty-four squares of equal size and arranged into eight rows of equal width, numbered 1 through 8. Although the size and number of rows can vary considerably, a representative tract 10 of sixty-four acres, where each acre is represented by one square in FIG. 1, can be successfully mined by division into eight rows of equal width. Sand tailings produced in the ore separation operation can be used at the top of deposited wastes to provide for some shrinkage in the consolidated mass of overburden and slimes.

In FIG. 2, washer plant 20 and flotation plant 22 receive ore from the ore-bearing stratum excavated from tract 10 of FIG. 1. Typically, a slurry is formed from such ore-bearing stratum with water, and the slurry is conveyed from tract 10 by pipeline to washer plant 20 and flotation plant 22, which can be located up to several miles from tract 10.

Ore beneficiation takes place in washer plant 20 and flotation plant 22 in a conventional manner and phosphate values from the phosphate pebble component of the ore-bearing stratum are removed. Waste slimes are produced in washer plant 20 and flotation plant 22 having from about 3 to about 5% solids in water suspension. When waste slimes are discharged from washer plant 20 into discharge line 24, flow meter 26 measures the flow rate through line 24, and transmits a signal along electrical line 27 to flow recorder 28 for recording flow through flow meter 26 on a chart or other suitable recording means. When flotation plant 22 discharges waste slimes into discharge pipe 30, flow meter 32 measures flow in pipe 30 and transmits a proportional electrical signal along electrical line 34 to flow recorder 28 for recording at a second chart, which can be a second pen on the chart used for recording the output transmitted from flow meter 26. Flow indicator 36, having electrical line 38 to flow sensor 39 in pipe 24 and electrical line 40 to flow sensor 41 in pipe 30, indicates whether flow is occurring in pipe 24 or in pipe 30. Indication of such flow can be displayed visually for use by a plant operator, such as by indicator lights showing flow of waste slime from washer plant 20 or from flotation plant 22. Differential controller 42 is connected by electrical line 44 to adjustable metering valve 46, and also by electrical line 48 to shutoff valve 50 and by electrical line 52 to shutoff valve 54. Differential controller 42 permits washer plant 20 output through line 24 to be directed into line 56 by closing of shutoff valve 54 and opening of shutoff valve 50, thereby feeding thickener 58 or, alternatively, differential controller 42 can permit output from washer plant 20 in line 24 to be furnished to line 60, feeding filter clarifier 62, by opening of shutoff valve 54 and closing of shutoff valve 50. In addition, differential controller 42 permits adjustment through adjustable metering valve 46 of the volume flowing to either clarifier 62 or thickener 58.

Storage vessel 64 contains a slurry of gypsum, which is delivered through volume control valve 66 to line 68 at pipe tee 69. Volume control valve 66 is an adjustable metering valve controlled by volume control sensor 70, and valve 66 is adjusted to provide a predetermined proportion of gypsum slurry from tank 64 through lines 68 and 72 and into thickener 58, the proportion being set by volume control 71. The flow in line 72 comprises the combined flow from line 68 and from line 74, line 74 comprising the output from clarifier 62 and having flow meter 76 to transmit by electrical line 78 to flow recorder 28 for recording on a chart the flow in line 74. Clarifier 62 is provided with a level controller comprising level control sensor 80, for measuring the level of fluid in clarifier 62 and controlling through electrical line 82 the flow through level control valve 84, which is an adjustable metering valve, thereby maintaining a predetermined level of fluid in clarifier 62. Thickener 58 is provided with a level controller comprising level control sensor 85, connected by electrical line 86 to level control valve 88, thereby maintaining fluid level in thickener 58 at a predetermined value. The output from thickener 58 passes into line 90 having flow meter 92 for measuring the flow in line 90. Electrical output from flow meter 92 is transmitted by electrical line 94 to flow recorder 28 for recording on a chart, such a fourth pen showing the flow in line 90 on a chart in recorder 28. Differential controller 96 in line 90 is connected to adjustable metering valve 98 by electrical line 100, and controller 96 regulates the flow through line 90 into mixing cone 102.

In a typical operation, fluid entering mixing cone 102 contains about 15% to about 18% by weight of solids, while fluid exiting clarifier 62 through line 74 contains about 10% to about 15% by weight of solids.

Hopper 104 contains overburden material stripped by suitable conventional means during excavation operations on tract 10, such as drag line or bucket wheel excavator. The important point in this case is the immediate utilization of the overburden as it is first handled by the excavator, which cuts down the cost of spoiling and rehandling operations, necessary in prior art reclamation operations. Feeder 106 carries sandy overburden from hopper 104 to conveyor 108, which is preferably a moving belt carried on rotating drums 110 and 112, each drum rotating in a counterclockwise manner to transport overburden deposited on conveyor 108 from feeder 106 into mixing cone 102. Gypsum can also be added to material carried along conveyor 108, as shown in FIG. 2. Dried, washed gypsum cake may be required due to environmental considerations. In a typical installation, the output from mixing cone 102 travels along pipeline 114 to a mined out row of tract 10 for deposition through floating deck discharge 116. Typically, the slurry in pipeline 114 from mixing cone 102 contains from about 30 to about 35% solids by weight, and contains about 10% gypsum by weight. Gypsum is added to increase the compaction of backfill ultimately produced. Mined-out pit 118, schematicized in FIG. 2 as a top view having dam 120 with spillway 122 allows settling of solids from slurry discharged through floating deck discharge 116 without separation of sand particles, and decanting of a clear upper water layer over spillway 122 into the portion of pit 118 to the right of dam 120. Clear water discharged over spillway 122 can then be recycled for reuse. Instead of discharge from mixing cone 102 through pipeline 114 into mined out pit 118, the discharge from mixing cone 102 can be fed through pipeline 124 into above ground storage reservoir 126, preferably having french drainage.

Figure 3:
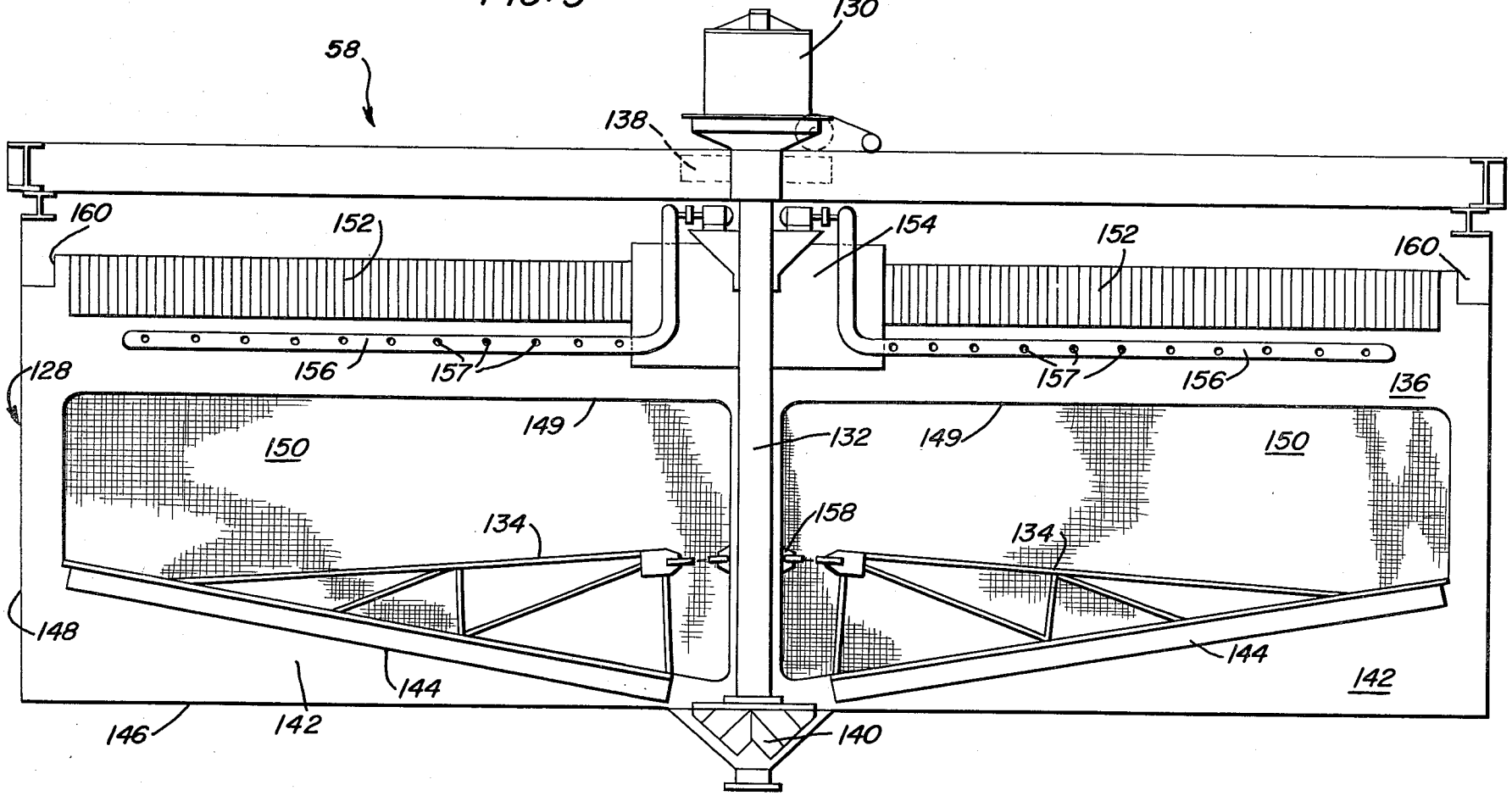
FIG. 3 is a diagrammatic, vertical, sectional view of the sand filtration apparatus of the present invention.

Clarifier 62 is of conventional construction and operation. It is constructed to treat flocculated slimes from washer plant 20 and flotation plant 22 with solids content of approximately 3% to 5% by weight in a manner to discharge solids in line 74 having from about 10% to about 15% solids by weight. Clarified water produced in such clarifying operation can be recycled for reuse. The construction of thickener 58, as illustrated in FIG. 3, permits such treatment within a reasonable time and within a thickener 58 of reasonable size through the combination of three essential features in thickener 58. First, an arrangement of vertical tubes bonded together provides a wall effect for promoting release of water from a slime slurry and drastically reducing required size of thickener 58. Second, a sand filter mechanism of dewatering with variable sand depth is provided with rakes having rotating arms which descend slowly during filtering. Third, release of lattice water from thickened clay suspension is accomplished by mechanical action, where the rake arms are provided with at least two sets of nylon netting to multiply the number of contacts with the thickened slimes.

Referring now to FIG. 3, showing thickener 62 with settling tank wall 148 and drive mechanism 130 for rotating shaft 132 and attached standard arms 134, a lowering device is provided which can lower rake arms 134 during processing of slimes 136 contained in settling tank 128. Drive mechanism 130 is provided with lowering device 138 for lowering rake arms 134 at a rate of approximately one-half inch per week until the lower limit of vertical travel of approximately 24 inches in approximately one month has been reached, at which time a limit switch in lowering device 138 is activated. The limit switch then causes the entire structure to be raised 24 inches to its initial position, and the scraping sequence is repeated. The triangular portions designated by the numeral 142 represent the final level of sand in tank 128 at the lowest position of rake arms 134. As an impermeable clay film deposits on top of sand contained at the bottom of tank 128, the film is removed by the slow downward motion of the rakes. This is necessary to prevent the filtration process through sand initially pumped into tank 128 from forming a layer of consolidated clay on top of the sand bed, resulting in a diminishing rate of filtration. When a sand slurry is pumped into tank 128, rake arms 134 rotate until the sand reaches a configuration determined by the rake blades 144 of rake arms 134. To those skilled in the art, it is known that the space between rake blades 144 of rake arms 134 and the bottom 146 of tank 128 in a typical settling tank 128 varies in depth from the outside wall 148 to the center or discharge 140, since normal rake motion to slowly bring settled solids towards the center requires a sloping firm bottom. Consequently, the sand depth will vary from wall 148 toward the center where it can have a minimum depth of about two to three feet. Furthermore, it is important that the sand bed in region 142 be provided with a separate drainage pipe and outlet for the fast release of filtered water. Filtration water drainage, however, is not shown in FIG. 3.

Rake arms 134 are provided with light structural arms 149, supporting at least two sets of nylon netting 150 in order to multiply the number of contacts with thickened slimes 136. Alternatively, expanded metal can be substituted for nylon netting 150. It is particularly important to provide nylon netting 150 as tank 128 increases in diameter, because in order to keep a minimum peripheral speed of rake arms 134, the rate of revolution of arms 134 must necessarily be reduced. When tank 128 reaches a diameter of 300 feet, at least four nylon netting light arms should be provided in addition to the two standard structural arms 149 shown in FIG. 3. The purpose of nylon netting 150 is to exert mechanical action on slimes 136 to release lattice water from the suspended solids by mechanical action, and thereby increase the effectiveness of dewatering.

Joined vertical partitions or honeycomb panels 152 in the shape of a disk lie in the upper portion of slimes 136 and surround the annular region between feed well 154 and side wall 148. When slimes 136 have solids content higher than about 4%, the slimes are made of intricate clay networks which oppose the passage of liquid released at lower thickening zones, such as the region about nylon netting 150, of settling tank 128. When disk-shaped honeycomb panels 152 are introduced in the tank, however, water from below travels faster upwardly through a molecular layer near the surface of the vertical partitions in honeycomb panels 152 than through the clay network itself. Since the speed at which water is released and reaches the top of settling tank 128 establishes the rate of settling and size required for tank 128, it follows that provision of many vertical surfaces, such as by means of vertical tubes bonded together, will multiply this water transport effect and thereby drastically reduce the size of settling tank 128 required.

Honeycomb panels 152 can be made of an inert material of any kind, such as plastic or metal, provided that the material of panels 152 can withstand exposure to sunlight, particularly ultraviolet radiation from sunlight, and do not deteriorate in water. Each individual vertical tube bonded together to form honeycomb panels 152 can have a horizontal cross section in the shape of a circle, hexagon, square, or other shape, but a preferred geometry is that of a hexagon forming a network of indefinite size, such as in the honeycomb manufactured by insects, such as honeybees. The hexagonal cell type facilitates use of very thin plastic material, for example, polystyrene of a thickness of 0.006 inches. Panels 152 can be prefabricated and shipped to the site of construction to minimize transportation space required. They are expanded into squares reinforced at their perimeter and floated in the upper portion of slimes 136 by four closed cell expanded cellular plastic floats, such as floats of styrofoam (not shown in FIG. 3), and form a floating disk of vertical tubes bonded together. Honeycomb panels 152 can have individual vertical tubes of hexagonal cross section which are effective with apothems up to about two inches. The objective of supporting honeycomb panels 152 by floating with floats is to avoid supporting structures for panels 152, which become expensive and cumbersome in the case of settling tank 128 of large diameter, for example, diameter larger than about 100 feet.

Feed distributor 156 extends radially outwardly from feed well 154, and has a plurality of orifices 157 along its length. The purpose of feed distributor 156 is to inject a sand slurry from feed well 154 when settler tank 128 is operated as a sand filter. However, where tank 128 is operated without the sand filter mechanism, piping similar to feed distributor 156 is installed just above rake blades 144 with the purpose of speeding up the motion of settled solids toward the center of tank 128. In such a configuration, submerged pumps capable of handling viscous fluids and located on rake arms 134 near center pier 158 perform the function of transporting settled solids towards the center of tank 128. Such transport is necessary in order to maintain high solids in the underflow and avoid short circuiting of feed which can occur in a tank 128 of large diameter. In effect, this feature is also applicable to clarifier 62.

To initiate operations, thickener rake arms 134 are set with rake blades 144 about 24 inches above the minimum layer of sand to be deposited in region 142. A sand slurry, preferably made from sand tailings, is injected from feed well 154 through feed distributors 156 with rake arms 134 rotating until sand deposited in region 142 reaches a configuration determined by rake blades 144 of rake arms 134. Waste slimes or slime-sand tailing mixes are then fed through feed distributor 156 for continuous operation of the filter thickener 58. As an impermeable clay film deposits on the top layer of sand in region 142, the film is removed by slow downward motion of rake arms 134 on shaft 132 during the course of rotation of rake arms 134 about shaft 132. The slow downward motion at a rate of approximately 24 inches of vertical travel in approximately one month, is accomplished by lowering device 138. When rake arms 134 have reached the lower limit of their vertical travel, they are raised to their initial position, sand is added to raise the sand bed, and the cycle is repeated. Three products are released from filter thickener 58. A clear overflow of water is released at launder 160, comprising water which can be recycled for reuse in washer plant 20 or flotation plant 22, or elsewhere. A second product is a thickened underflow discharged continuously at cone discharge 140. A third product is clear, filtered water drained from the sand bed in region 142 at a sand bed drain (not shown) in FIG. 3.

The major portion of water will be released by ordinary sedimentation. The sand bed, however, releases additional water from the slimes 136, drawing its share of water from thickened layers of clay containing solids in the range of about 10 to about 15% by weight. Such slimes settle very slowly and require large thickening areas. This water, referred to in the art as lattice water, is released in thickener 58 of the present invention by the combination of nylon netting 150 and the sand bed in region 142.

It is to be understood that there is no required relationship between the depth of the sand bed in region 142 and that of the height of liquid in settler tank 128 in order for the process and apparatus of the present invention to function properly.

Thickener underflow from cone discharge 140 emerges into line 90 at approximately 14 to 15% by weight of solids. Thickener underflow from thickener 58 is proportioned in mixing cone 102 with overburden from conveyor 108 and forms a slurry carried in pipeline 114 with about 35 to about 50% solids, for discharge into a previously mined out pit 118, following the pattern of alternate row excavation and backfilling described above.

Figure 5:
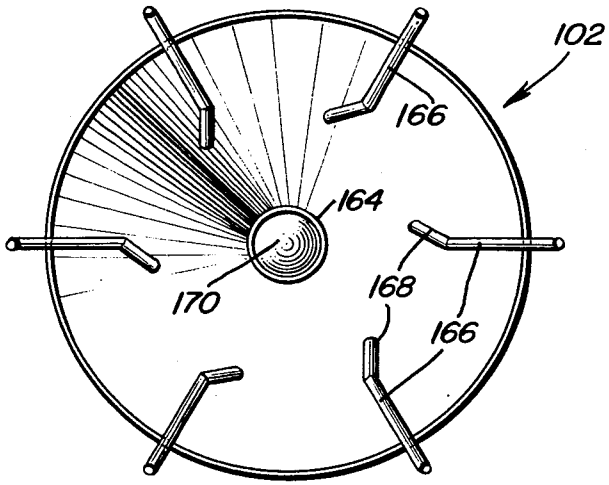
FIG. 5 is a top plan view of the mixing cone used to mix solid overburden with the thickened slurry produced by the sand filtration apparatus of the present invention.
Figure 6:
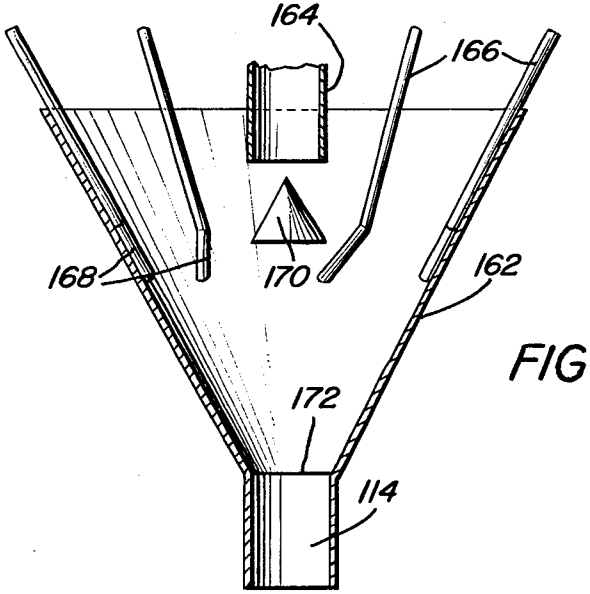
FIG. 6 is a diagrammatic, vertical, sectional view of the mixing cone.

FIGS. 5 and 6 show the construction of mixing cone 102. Cone walls 162 receive solids from conveyor 108 through inlet pipe 164, as well as thickened slimes from pipe 90, which subdivides into six pipes for feeding fluid inlet pipes 166 extending downwardly along the inside surface of the walls 162 of cone 102, and having angulated tips 168 to produce a swirling or vortical fluid motion to promote mixing with solids entering cone 102 from inlet pipe 164. Solids dropping downwardly through inlet pipe 164 strike the conical surface of deflector 170 and are thereby directed to wall 162, where mixing with fluid discharged through angulated tips 168 occurs. The mixture then travels downwardly by gravity through the throat 172 of mixing cone 102 and into pipeline 114 for conveying as a slurry to floating deck discharge 116 at mined-out pit 118.

Figure 8:
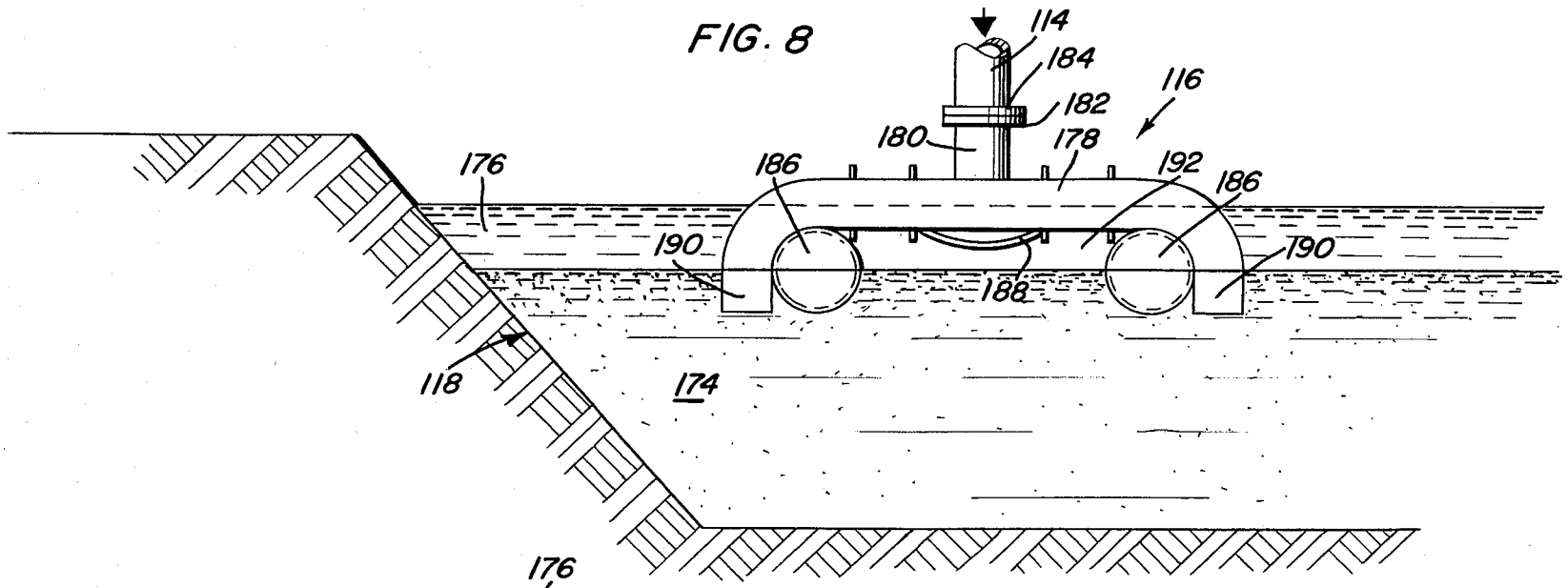
FIG. 8 is a side elevational view of the floating platform in the pit.
Figure 7:
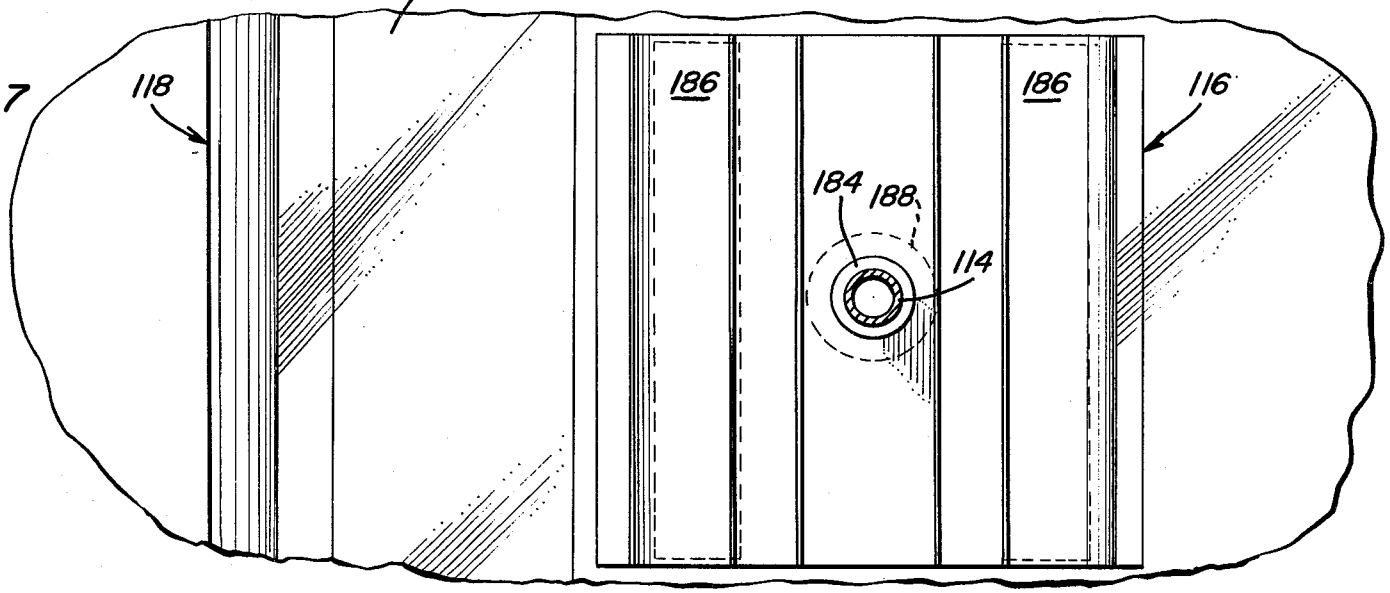
FIG. 7 is a top plan view of the floating platform designed for discharging the output of the mixing cone into a mined out pit.

FIGS. 7 and 8 show a floating deck discharge 116 located in mined-out pit 118 having a layer of thickened slimes 174 and a less dense clarified supernatant layer 176 of reusable water. Floating deck discharge 116 permits introduction of slurry from pipeline 114 into mined-out pit 118 without mixing with supernatant layer 176 or sand separation. Floating deck discharge 116 comprises supporting housing 178, inlet pipe 180 having flange 182 to connect with the corresponding flange 184 of pipeline 114, float 186, and deflector plate 188. Floats 186, which can be metal cylinders or drums, provide the degree of buoyancy necessary to support near the surface of slimes 174 the entire structure of floating deck discharge 116 and associated components. Thickened slimes from pipeline 114 enter floating deck discharge 116 at inlet 180 and strike deflector plate 188, which can be made of suitable abrasion resistant plastic or metal material. Spilling over the edge of plate 188, the material then enters thickened slimes 174 without mixing with surrounding supernatant layer 176, due to downwardly depending wings 190 of housing 178. Wings 190 extend about the entire periphery of housing 178, forming an enclosed region 192. Due to the discharge of thickened slimes into mined outpit 118 without disturbing supernatant layer 176, sand separation is avoided, and compaction of thickened slimes 174 thereby promoted.

EXAMPLE I

TABLE

Tests were conducted on three blends of overburden and slime under three sets of conditions to test the stability of soils resulting from overburden and slime mixtures. Test No. 10 contrasts the result with slimes alone.

| Test No. | Test Cond. | Ratio O'burden/ Slimes (Dry basis) | Slimes % Solids | O'burden/ Slimes Blend % Solids | Time to Reach Liquid Limit | Time to Reach Plastic Limit | Volume Redn. % | Load Bearing Test Psi | Atterberg Limits Lig. Limit | Atterberg Limits Plastic Limit | Plasticity Index |
|---|---|---|---|---|---|---|---|---|---|---|---|
| 1 | Grad. Cyl. | 4.78/1 | 15.3 | 52.2 | 1 Week | 4 Weeks | 27.9 | — | — | — | — |
| 2 | 4 Ft. Cyl. | 4.78/1 | 15.3 | 52.2 | 1½ Weeks | 6 Weeks | 28.4 | — | — | — | — |
| 3 | Wood Box | 4.78/1 | 15.3 | 52.2 | 1 Week | 5 Weeks | 27.8 | — | 64.0–28.1 | | 35.9* |
| 4 | Grad. | | | | | | | | | | |

TABLE-continued

Tests were conducted on three blends of overburden and slime under three sets of conditions to test the stability of soils resulting from overburden and slime mixtures. Test No. 10 contrasts the result with slimes alone.

| Test No. | Test Cond. | Ratio O'burden/ Slimes (Dry basis) | Slimes % Solids | O'burden/ Slimes Blend % Solids | Time to Reach Liquid Limit | Time to Reach Plastic Limit | Volume Redn. % | Load Bearing Test Psi | Atterberg Limits Lig. Limit | Atterberg Limits Plastic Limit | Plasticity Index |
|---|---|---|---|---|---|---|---|---|---|---|---|
| 5 | Cyl. 4 Ft. | 4.3/1 | 20.51 | 55.72 | 1 Week | 6 Weeks | 28.9 | — | — | — | — |
| 6 | Cyl. Wood Box | 4.3/1 | 20.51 | 55.72 | 1 Week | — | 26.7 | — | — | — | — |
| 7 | (Covered) Grad. | 4.3/1 | 20.51 | 55.72 | 1½ Weeks | 6 Weeks | 27.2 | 18 | 53.1–20.7 | | 32.4 |
| 8 | Cyl. 4 Ft. | 3/1 | 17.4 | 46.33 | 1 Week | 6 Weeks | 32.0 | — | — | — | — |
| 9 | Cyl. Wood Box | 3/1 | 17.4 | 46.33 | 1½ Weeks | — | 31.7 | — | — | — | — |
| 10 | Slimes Alone | 3/1<br>0 | 17.4 | 46.33 | 1 Week<br>15% S<br>4 Years | —<br>60% S | 32.2 | — | 64.0–27.3<br>455–66.7 | | 36.7<br>388.3** |

*Suitable for normal land utilization.
**Unsuitable for any land utilization.

EXAMPLE II

Figure 4:
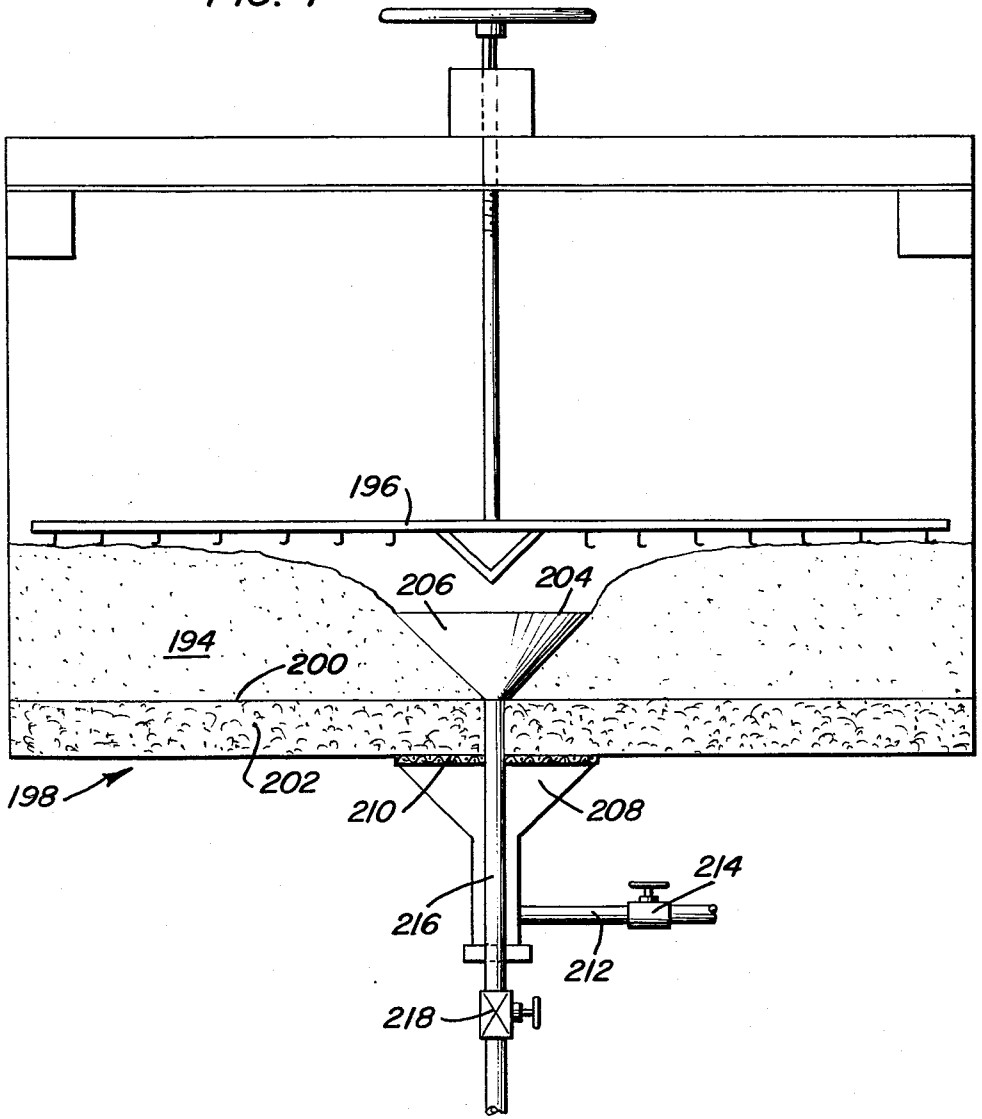
FIG. 4 is a vertical, sectional view of testing apparatus used in developing data of Example III.

A sand bottom 194 was placed beneath the rake 196 of clarifier 198 constructed as shown in FIG. 4. Screen 200 to retain sand bottom 194 was placed over layer 202 of pebbles approximately three inches in thickness. Sand bottom 194 sloped downwardly toward the rim 204 of funnel discharge 206, which served as an outlet for slimes underflow. A second outlet for filtration water 208 is provided, water flowing through screen 210 and exiting through pipe 212, as controlled by valve 214. Slimes underflow from funnel 206 travels downwardly through pipe 216 and is discharged by opening valve 218. Settler rake 196 was raised to the configuration shown in FIG. 4, just above the highest level of sand 194, namely about nine inches. Results of one week of operation with and without sand 194 gave the following average data:

| | Standard Run | Sand Filtration Run |
|---|---|---|
| Feed rate (gallons per hour) | 35.2 | 54.9 |
| Feed percent solids | 3.08% | 3.45% |
| Underflow rate (gallons per hour) | 11.53 | 23.3 |
| Underflow percent solids | 6.83% | 7.88% |
| Settler ($ft^2$/TPD*) | 251 | 101 |

*TPD = Tons per day.

Results of Example I show the improved soil stability which results from blending of slimes with overburden.

Results of Example II show the improved efficiency of dewatering of clay slimes when sand flitration is used, since the settler area required was found to be approximately 60% less when sand filtration was used.

Among the advantages resulting from the method and technique disclosed above are the following:

Economic dewatering of slimes is produced in ore treatments, with elimination of pollution hazards resulting from failure of retaining pond dams. Improved process control results in attaining reclamation of 100% of surface area mined; and conservation of water is achieved with increased recovery of water resources.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A method of reclamation of a tract of land in the surface mining of an ore-bearing stratum and an overburden stratum overlying the ore-bearing stratum comprising the steps of:

(a) dividing said tract into a plurality of parallel strips, numbered consecutively from an edge of said area as the first strip, second strip, and the like;

(b) excavating and storing the overburden stratum from said first strip;

(c) forming a first strip mined-out pit by excavating and transporting to a processing plant the ore-bearing stratum from said first strip, said processing plant being adapted to separate said ore-bearing stratum into an ore and a waste product of said first strip and treat said waste product to produce a dewatered waste product;

(d) initiating excavation of said overburden from said third strip;

(e) mixing said overburden from said third strip with said dewatered waste product of said first strip to form a backfill;

(f) transporting said backfill to said first strip mined-out pit while said third strip is being excavated;

(g) repeating sequentially steps (c) through (f) for all odd-numbered strips; and (h) repeating sequentially steps (c) through (f) for all even-numbered strips.

2. The method of claim 1 wherein said processing plant includes a washer plant, a filtration plant, and a dewatering system.

3. The method of claim 2 wherein said dewatering system includes a thickener comprising at least one cylindrical tank partially filled with sand and having an axial vertical shaft with radially attached rake arms for rotation about said shaft, said rake arms having netting for exerting mechanical action on said waste product in said tank, said tank having above said rake arms a disk formed of a plurality of vertical tubes bonded together, said disk being submerged in the upper portion of said waste product in said tank.

4. The method of claim 3 wherein said rake arms are vertically adjustable on said shaft.

5. The method of claim 4 wherein said netting is nylon.

6. The method of claim 5 wherein said waste product comprises a suspension of clay in water.

7. The method of claim 6 wherein said clay is selected from a group consisting of montmorillonite, attapulgite, and mixtures thereof.

8. The method of claim 7 wherein said ore is phosphate ore.

9. The method of claim 8 wherein said overburden stratum is substantially quartz sand.

10. The method of claim 9 wherein said waste product is mixed with said overburden in a mixing cone to form a slurry.

11. The method of claim 10 wherein said slurry is transported to a floating deck discharge in said mined-out pit.

12. The method of claim 11 wherein gypsum is added to said waste product.

13. The method of claim 12 wherein said gypsum is added as a slurry at a predetermined level to the waste product entering said thickener.

14. The method of claim 12 wherein said gypsum is added to said overburden entering said mixing cone.

15. The method of claim 10 wherein said slurry from said mixing cone is placed in an above ground storage reservoir before transporting to said mined-out pit.

16. The method of claim 10 wherein said mixing cone comprises an upwardly opening conical surface, a plurality of inlet lines for discharging said waste product in said mixing cone, an axially disposed inlet pipe for discharging said overburden downwardly within said conical surface, and a conical deflector pointed upwardly for deflecting said overburden from said inlet pipe onto said conical surface.

17. The method of claim 16 wherein a level control sensor and a level control valve regulate the flow of said waste product into said thickener.

18. The method of claim 11 wherein said floating deck discharge comprises a floating deck platform having submerged wings, a plurality of buoyant floats, and a deflecting plate adapted to deflect incoming backfill.

19. The method of claim 18 wherein a a clarifier and thickener are connected in series.

20. The method of claim 12 wherein said gypsum is added dry to the waste product.

* * * * *